US007228603B2

(12) United States Patent
Craig

(10) Patent No.: US 7,228,603 B2
(45) Date of Patent: Jun. 12, 2007

(54) CONTAINMENT SYSTEM

(75) Inventor: Emily A. Craig, Georgetown, KY (US)

(73) Assignee: Bluegrass Bio, Inc., Frankfort, KY (US)

( * ) Notice: Subject to any disclaimer, the term of this patent is extended or adjusted under 35 U.S.C. 154(b) by 256 days.

(21) Appl. No.: 10/513,645

(22) PCT Filed: May 7, 2003

(86) PCT No.: PCT/US03/14334

§ 371 (c)(1),
(2), (4) Date: Nov. 5, 2004

(87) PCT Pub. No.: WO03/095314

PCT Pub. Date: Nov. 20, 2003

(65) Prior Publication Data

US 2005/0138783 A1 Jun. 30, 2005

Related U.S. Application Data

(60) Provisional application No. 60/378,247, filed on May 7, 2002.

(51) Int. Cl.
*A61G 1/00* (2006.01)

(52) U.S. Cl. ..... 27/28; 27/11; 312/1; 383/63; 383/66

(58) Field of Classification Search ..... 27/11, 27/28, 35; 312/1; 383/66, 63, 106
See application file for complete search history.

(56) References Cited

U.S. PATENT DOCUMENTS 2,219,564 A 10/1940 Reyniers
3,051,164 A 8/1962 Trexler
3,788,374 A 1/1974 Saijo
3,850,172 A 11/1974 Cazalis
4,335,712 A 6/1982 Trexler
4,485,490 A 12/1984 Akers et al.
4,598,834 A 7/1986 Singletary, Jr.

(Continued)

FOREIGN PATENT DOCUMENTS

FR 2546748 * 12/1984

(Continued)

*Primary Examiner*—William L. Miller
(74) *Attorney, Agent, or Firm*—King & Schickli, PLLC

(57) ABSTRACT

A body bag is provided comprising a substantially planar, optically transparent envelope defining an interior and having an opening extending substantially along a length dimension thereof. A closure for sealing the opening is provided comprising a rib and groove structure and an adhesive flap for impermeably sealing the closure. Conveniently, the body bag envelope may be dimensioned to allow placement in an interior for a conventional body bag. At least one access means formed through the envelope material for accessing the interior of said envelope is provided, spaced along an opposite length dimension of the envelope from the opening. The access means may include unidirectional infusion or extraction ports, integral gloves for accessing the interior of the envelope, self-sealing injection ports, or combinations thereof. A second adhesive flap is provided for sealing the access means, thereby providing an impermeable seal of the envelope to prevent contamination of the environment with any hazardous contents of the envelope. The invention further provides a method for isolating a contaminated cadaver from contact with the environment.

19 Claims, 3 Drawing Sheets

U.S. PATENT DOCUMENTS

| | | | | | |
|---|---|---|---|---|---|
| 4,780,940 | A | | 11/1988 | Jay | |
| 4,790,051 | A | | 12/1988 | Knight | |
| 5,342,121 | A | | 8/1994 | Koria | |
| 5,437,602 | A | | 8/1995 | Polyakov et al. | |
| 5,520,449 | A | * | 5/1996 | Klak | 312/1 |
| 5,620,407 | A | | 4/1997 | Chang | |
| 5,659,933 | A | | 8/1997 | McWilliams | |
| 5,671,983 | A | | 9/1997 | Miller et al. | |
| 5,715,583 | A | * | 2/1998 | Sandoval | 27/11 |
| 5,924,181 | A | * | 7/1999 | Takasugi | 27/11 |
| 6,004,034 | A | * | 12/1999 | Salam | 383/66 |
| 6,231,553 | B1 | | 5/2001 | Hulett | |
| 6,793,617 | B2 | * | 9/2004 | Ford et al. | 600/21 |
| 2003/0127950 | A1 | * | 7/2003 | Tseng et al. | 312/1 |
| 2003/0127952 | A1 | * | 7/2003 | Friedenbach | 312/1 |
| 2003/0145443 | A1 | * | 8/2003 | Lee | 27/28 |
| 2004/0027036 | A1 | * | 2/2004 | Hall | 312/1 |

FOREIGN PATENT DOCUMENTS

| | | | |
|---|---|---|---|
| GB | 2115690 | * | 9/1983 |
| WO | WO9828974 | * | 7/1998 |

* cited by examiner

CONTAINMENT SYSTEM

This application claims the benefit of U.S. Provisional Application Ser. No. 60/378,247, filed May 7, 2002.

FIELD OF THE INVENTION

This invention relates generally to the field of body bags or pouches. In particular, the present invention relates to a body or cadaver bag or pouch for use in situations involving suspected or known hazardous materials, such as chemical spills, biological agents, or other biohazards.

BACKGROUND OF THE INVENTION

In certain disaster or disease situations, it is often necessary to immediately isolate the victims. For example, in a situation such as a hazardous chemical spill or the deliberate or accidental release of lethal toxins, diseases, or other a biological contaminants (hereinafter referred to generally as a biohazard), the bodies of the victims may represent a danger, especially to medical and rescue personnel dispatched to the scene of the disaster. Onlookers and funerary staff are also at risk. Often, the cause of death is not immediately discernible, and accordingly medical personnel cannot determine specific measures for decontamination of the victims in sufficient time to prevent danger to others. Even if the cause of death is determined, often suitable decontamination procedures are not available for certain types of biohazards. In these situations, the primary goal is immediate containment of the corpse to allow rescue, medical, and other personnel to continue their work with a measure of safety.

In a disaster involving a biohazard, full autopsy procedures may be neither necessary nor, depending on the biohazard involved, advisable. However, some limited procedures may be necessary. For example, the body of the victim must be identified to allow notification of family members. Limited access to the victims personal effects may therefore be necessary. If available, some measure of decontamination may be desirable, particularly in cases where the cause of death remains active, such as nerve gas or a biological hazard such as smallpox. Some funerary procedures, such as embalming, may also be desirable. In such cases, a primary concern is still containment of the biohazard-contaminated victim to protect others.

It is conventional practice for storing and transporting deceased individuals to place the bodies in containment vessels, generally referred to as "body bags." Such body bags are effective for their intended purpose under normal situations. However, in the case of a disaster involving biohazardous substances, conventional body bags do not provide the required level of containment to assure the safety of others. Additionally, most conventional body bags are opaque. Even in those bags that allow limited viewing, when some post-mortem examination or procedure is required, the conventional body bag must be opened to allow access to the victim, increasing the risk to others.

Accordingly, there is a need in the art for a means for storing/transporting deceased victims, while preventing the spread of the biohazardous cause of death. There is further a need in the art for such a containment system which allows limited procedures, such as identification of the victim, rapid and safe analysis of the contaminant, decontamination if possible, and funerary procedures.

SUMMARY OF THE INVENTION

In accordance with the foregoing, in one aspect the present invention provides a body bag for isolating a cadaver, comprising a substantially planar, optically transparent envelope defining an interior. The envelope includes an opening extending substantially along a length dimension of the envelope, and further includes a closure for impermeably sealing the opening. Typically, the envelope will be dimensioned to allow placement in an interior of a conventional body bag. It will be appreciated that this feature allows the transparent body bag of the present invention to be stored and/or transported in a conventional opaque body bag, thereby hiding the contents from inadvertent view by family members, members of the press, and the like. Concealment of the bag of the present invention in a conventional body bag further provides a second level of containment, thereby increasing the security of personnel.

The closure may include a rib and groove structure, similar to those marketed under the trademark ZIPLOC. As will be appreciated by the disclosure that follows, the closure should be of sufficient size and thickness to allow handling and closing by personnel wearing protective handwear such as thick rubber gloves. The closure further may include a first adhesive flap which may be integral to the envelope. The first adhesive flap typically co-extends substantially the length of the opening, and is adapted for folding over and adhering to the envelope material whereby the opening is impermeably sealed. This prevents inadvertent contact of the contents of the body bag, and any contaminants which may be associated therewith, with the environment and with personnel handling the body bag of the present invention.

The body bag of the present invention may further include at least one access means formed through the envelope material for accessing the interior of the envelope. The access means are typically spaced along an opposite length dimension of the envelope opposite from the opening. A second adhesive flap integral to the envelope and adapted for folding over and adhering to the envelope material may be provided. The second adhesive flap typically co-extends along a sufficient distance of the opposite length dimension of the envelope to impermeably seal the access means when folded over. Any of a number of known access means may be included in the body bag of this invention to allow limited access to the interior of the envelope after the closure is sealed, such as an injection port having a self-sealing septum, a unidirectional infusion port for infusing a substance into the interior of the envelope, and/or a unidirectional extraction port for extracting a substance from the interior of the envelope. Such ports are known in the art. The interior of the envelope may also be accessed by at least one sleeve extending from a surface of the envelope into the interior of the envelope and defining a glove, wherein the sleeve further defines an opening formed through the envelope material. Typically, the sleeve will terminate in a glove, allowing limited manipulation of the contents of the bag after sealing.

Additional features may be provided with the body bag of the present invention. The bag may include carrying handles to increase ease and convenience of transport, one or more label surfaces for recording desired information on the envelope, and a ruled scale for measuring a length and/or width of an object placed in the envelope. The body bag may further include a unique identifier for acquiring information concerning a particular bag at a distance. Typically, the unique identifier will be a scannable bar code for acquisition of identifying information regarding said cadaver from a distance. Such bar codes and scanners therefore are known in the art.

In another aspect, the present invention provides a method for isolating a contaminated cadaver from contact with the environment, comprising the steps of placing the cadaver into an interior of a substantially planar, optically transparent envelope. The envelope is configured substantially as described supra, having an opening extending substantially along a length dimension thereof, a rib-and-groove closure for closing the opening, and a first adhesive flap integral to the envelope, co-extending substantially the length of the opening, and adapted for folding over and adhering to the envelope material. The rib and groove closure is then closed, and the first adhesive flap is folded over to adhere to the envelope material, whereby the opening is impermeably sealed and the contents of the envelope are prevented from contact with the exterior of the envelope.

In still yet another aspect of the present invention, a body bag for holding and isolating a cadaver is provided, comprising a substantially planar, optically transparent envelope defining an interior, and having an opening extending substantially along a length dimension of said envelope. A rib and groove closure is provided for closing the opening. Additionally, a first adhesive flap is provided integral to the envelope, co-extending substantially the length of the opening and adapted for folding over and adhering to the envelope material to impermeably seal the opening. The envelope may also include at least one access means formed through the envelope material for accessing the interior, typically being spaced along an opposite length dimension of the envelope from the opening. The access means may be selected from the group consisting of an injection port having a self-sealing septum, a self-sealing unidirectional infusion port, a self-sealing unidirectional extraction port, at least one sleeve extending from a surface of the envelope into the interior of the envelope and defining an opening formed through the envelope material and terminating in a glove, and any combination thereof.

The body bag may also include a second adhesive flap integral to the envelope which is adapted for folding over and adhering to the envelope material. The second adhesive flap preferably extends along a sufficient length of the envelope length dimension opposite the opening, to impermeably seal the access means when folded over. Additional features, such as a bar code, carrying handles, labels, and ruled scales may be provided as described above.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification illustrate several aspects of the present invention and, together with the description, serve to explain the principles of the invention.

In the drawing.

Reference will now be made in detail to the presently preferred embodiment of the invention, an example of which is illustrated in the accompanying drawings.

DETAILED DESCRIPTION OF THE INVENTION

Figure 1:
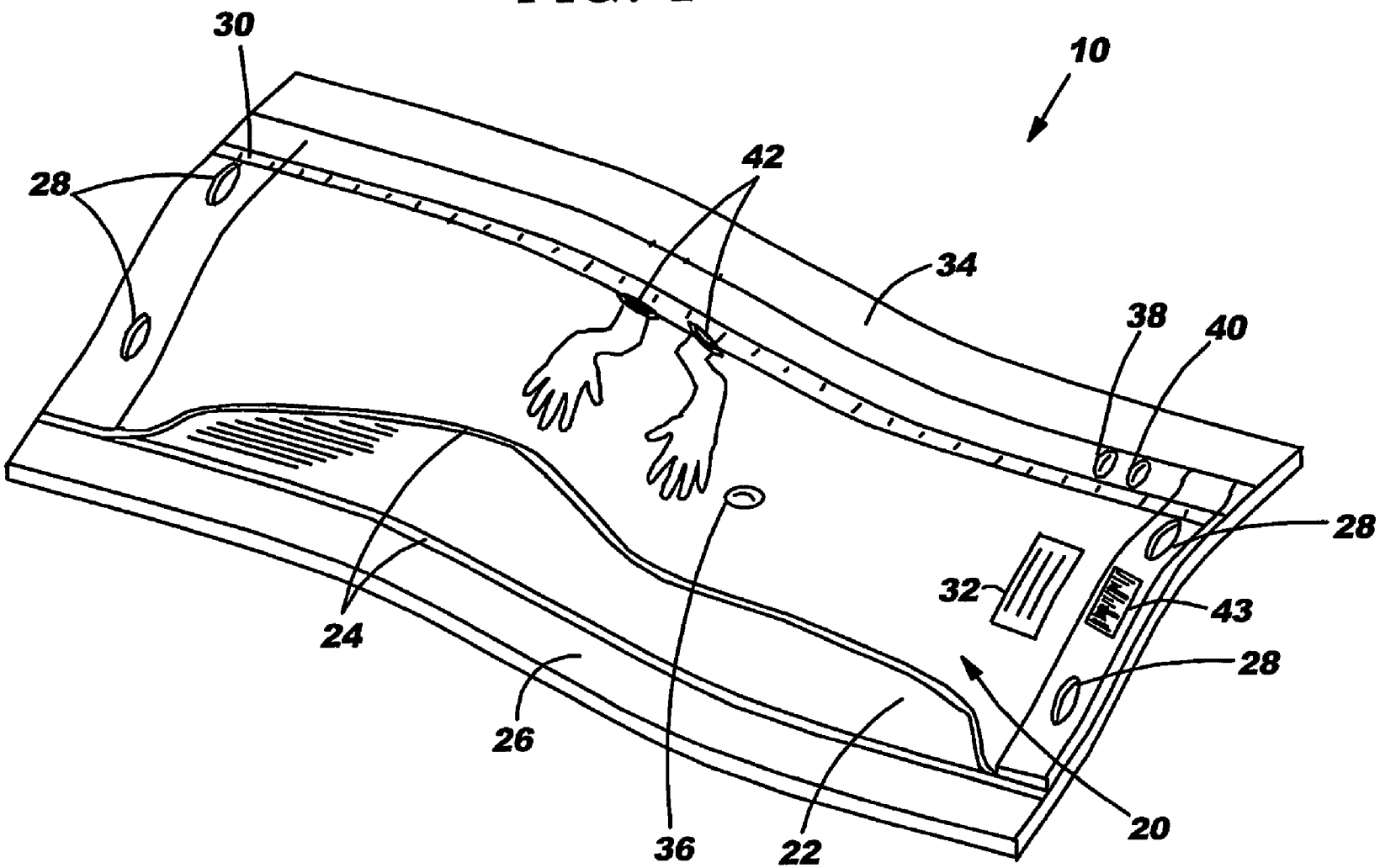
FIG. 1 illustrates the body bag of the present invention, with the opening positioned to allow placement of a cadaver in the interior of the envelope.

In one aspect, the containment system of the present invention, as shown in FIG. 1, provides a body bag 10 for isolating a cadaver, comprising a substantially planar, optically transparent envelope 20 defining an interior, and having an opening 22 extending substantially a length dimension of the envelope 20. It will be appreciated that the use of a substantially transparent envelope allows visual identification of a victim, recordation of identifying marks such as tattoos or scars, and the like without requiring personnel to actually handle the body. The body bag 10 may be fabricated of any suitable material having the required properties of optical transparency, gas and fluid impermeability, and puncture resistance. The body bag 10 must further be durable enough to support the weight of a cadaver placed therein. Such materials are known in the art. Desirably, the body bag 10 of the present invention may be dimensioned to allow placement within a conventional body bag (not shown) if necessary for transport and/or visual concealment.

Figure 2:
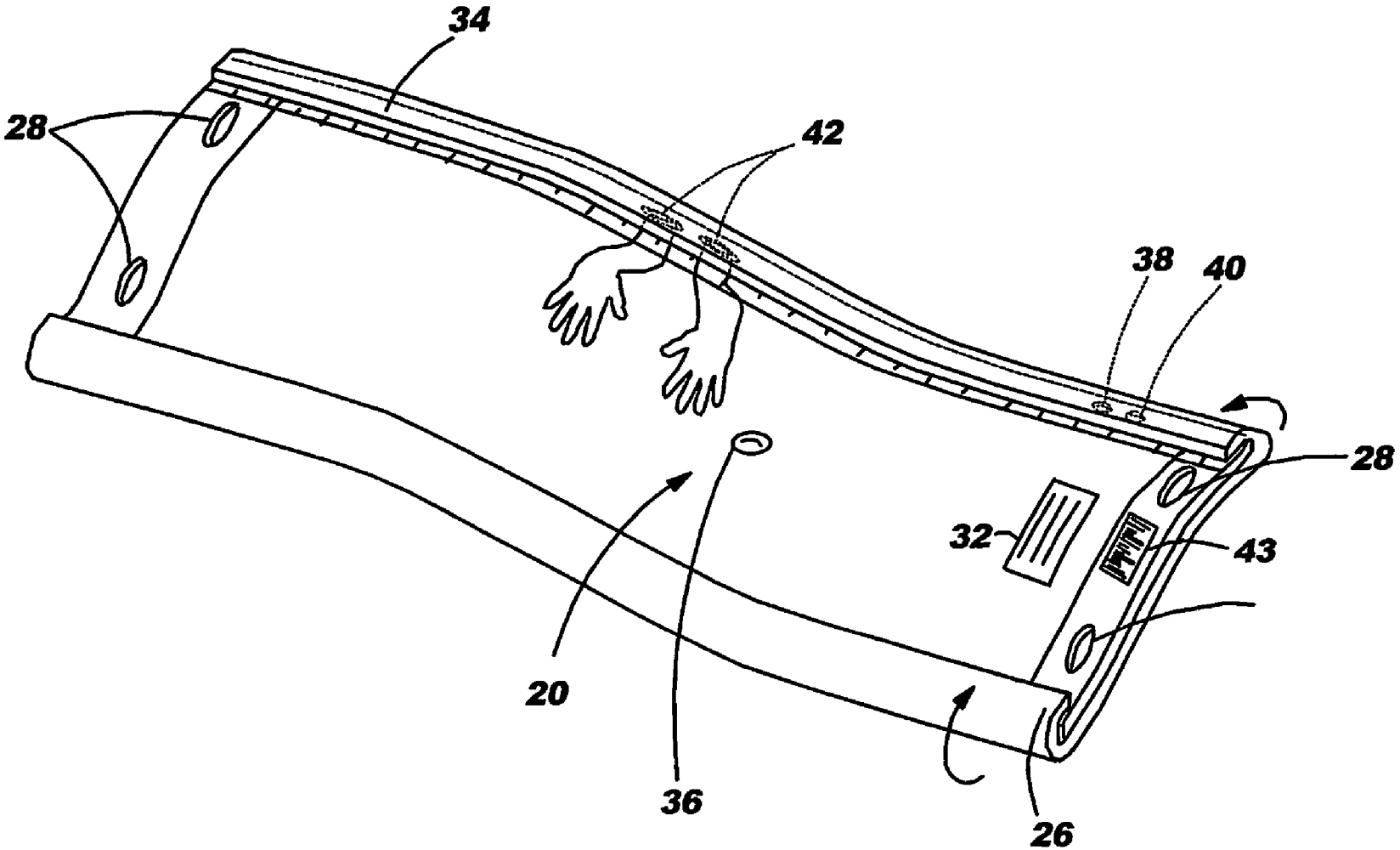
FIG. 2 illustrates the body bag of the present invention having the opening closed, with first and second adhesive flaps folded over to impermeably seal the interior of the envelope.

The body bag 10 further includes a closure for closing and sealing the opening 22. In a preferred embodiment, the closure comprises a rib and groove structure 24, known in the art and marketed under the trademark ZIPLOC. The rib and groove structure is desirably of a size to allow convenient manipulation by personnel wearing protective gear, such as heavy polymer or rubber gloves. It will be appreciated that other types of closure systems may be suitable, such as a heavy duty marine-grade zipper (not shown). The closure further comprises a first adhesive flap 26 for sealing the opening 22 after it has been closed by the rib and groove structure 24. Adhesive flap 26 typically co-extends substantially the length of the opening 22. Any suitable adhesive having the required ability to provide a gas-/fluid-impermeable and solvent-resistant seal is suitable for the present invention. As shown in FIG. 2 appended hereto, the adhesive flap 26 is adapted for folding over and thereby sealing the opening 22 and rib and groove structure 24, preventing the accidental escape of gases or fluids through the closure.

The body bag 10 may include handles 28 to allow carrying the body bag 10 and a cadaver placed therein with greater ease. In the embodiment shown in FIGS. 1-3, the handles 28 are formed integrally in the material of the body bag 10. However, separately attached or removable handles are also suitable. At least one ruled scale 30 may also be included along a length dimension of the envelope 20, allowing determination of the approximate height and/or width of the victim placed therein. A label 32 may also be included, to allow recordation of desired information.

The body bag 10 may also include one or more access means for accessing the interior of the envelope 20 to allow limited post-mortem procedures or funerary procedures, such as identification of the victim from personal effects, obtaining samples of blood or other fluids, and introduction and withdrawal of gases and fluids into the interior of the envelope 20. The access means are typically spaced on a length dimension of the envelope 20 opposite the opening 22. A second adhesive flap 34, substantially similar to the first adhesive flap 26, is provided on the opposite side of the envelope 20 from the closing means 24. The use of the second adhesive flap 34 will be described in greater detail below.

The access means for accessing the interior of the envelope 20 may take several forms. The envelope 20 may include at least one injection port 36 having a self-sealing septum. Such ports are known in the art. Because the injection port 36 is self-sealing, it may be located at any desired situs on the envelope 20 without need for a secondary sealing mechanism. However, to further reduce risk of contamination it may be desirable to locate any injection ports in proximity to second adhesive flap 34. The envelope 20 may also include at least one unidirectional infusion port 38, and at least one unidirectional extraction port 40, also located in proximity to second adhesive flap 34. In an alternative embodiment (not shown), a single self-sealing port may serve the function of allowing infusion and extraction of desired fluids and gases.

In certain situations, limited handling of the cadaver may be necessary, for example to manipulate the cadaver for photographs, to remove identification or other personal effects from the cadaver's pockets, and the like. Of course, the safety of the medical personnel is still a paramount concern due to the biohazard or other contaminant involved. Accordingly, access means in the form of at least one sleeve 42 may be provided to allow personnel "hands-on" access to the interior of the envelope 20. Such sleeves 42, preferably terminating in a standard glove design having fingers and a thumb, are known in the art. Once the desired procedures have been completed, it is desirable to seal the access means described above to further reduce the risk of escape of any hazardous substances contained in the envelope 20. Accordingly, second adhesive flap 34 may be folded over and adhered to the envelope 20 material as shown in FIG. 2 to form an impermeable seal over all the access means.

It may also be desirable to provide a means for identifying a particular body bag 10, and for conveying desired information about the contents therein. Such means should desirably allow identification of the bag 10 from a distance, such as from passing car or an aircraft flying overhead. In a preferred embodiment, a bar code 43 may be included on a surface of the envelope 20 visible to such passing vehicles. Such bar codes, and scanners (not shown) for scanning the bar codes 43 are known in the art, such as for example the bar code/scanner combinations used for identifying tractor-trailers in the trucking arts.

Figure 3:
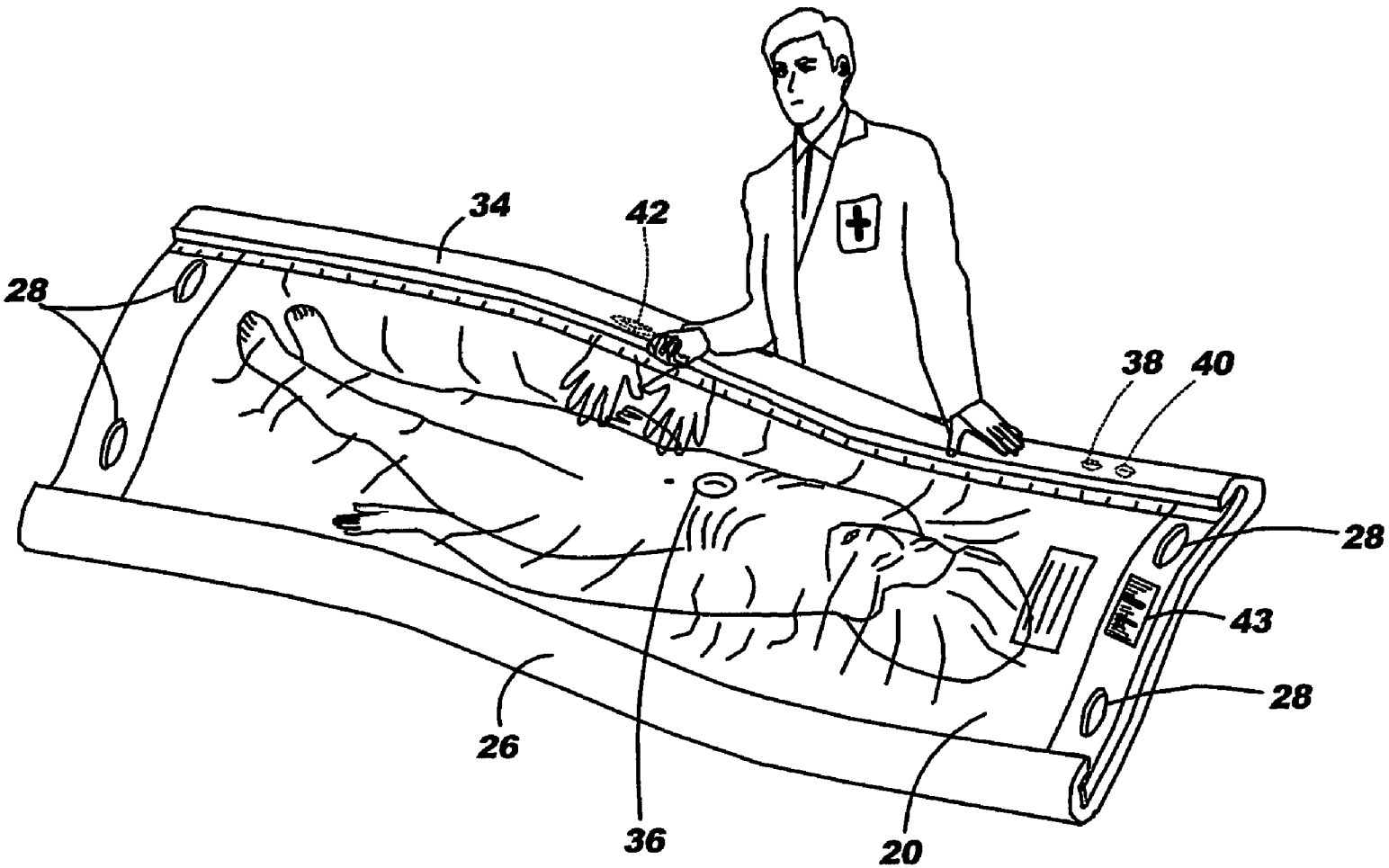
FIG. 3 shows the body bag of FIGS. 1 and 2, with a cadaver contained therein and first and second adhesive flaps folded over to impermeably seal the interior of the envelope.

The advantages of the body bag 10 of the present invention should thus be immediately apparent to those skilled in the art, and provide a method for isolating a contaminated cadaver from the environment, and from personnel responding to the scene. Upon arrival at the scene of a disaster involving a biohazard, the primary concern is to isolate the deceased to reduce the likelihood of contamination of rescue and medical personnel with the biohazard. Rescue/medical personnel may immediately place the contaminated cadaver in the envelope 20 through opening 22, close rib and groove structure 24, and fold adhesive flap 26 over to seal the opening 22. This is best shown in FIG. 3. In this way, the biohazard-contaminated cadaver is immediately contained, and risk to rescue and medical workers is reduced.

Because the envelope 20 is optically transparent, personnel are able to visually ascertain certain information regarding a contaminated cadaver without having to actually handle the cadaver. Accordingly, the safety of personnel is increased. Suitable information such as race, gender, indicia of external trauma, and the like may be determined. The victim's approximate height may be measured using the ruled scale 30. The cadaver may be weighed, photographed, x-rayed, and even fingerprinted using known scanning technologies. Information regarding the victim may be recorded on the labeling area 32, along with other desired information such as date and location of the disaster, type of biohazard involved (if known), and the like. This information may be critical in, for example, identifying the victim to allow notification of family members.

If further procedures must be conducted to ascertain information about the victim, the means for accessing the interior of the envelope 20 allows such procedures while continuing to keep the cadaver isolated. For example, blood samples may be drawn through injection port 36 to assist in determining the cause of death. Because the injection port 36 is self-sealing, safety of the personnel involved is maintained. The sleeves 42 allow limited handling of the cadaver without opening envelope 20, such as searching the victim's pockets for identification. The infusion port 38 allows introduction of desired gases and fluids, such as decontaminating substances if the contaminant has been identified, or embalming fluids to achieve sufficient embalming of the victim for interment. The extraction port 40 allows withdrawal of such substances and suitable disposal or analysis of any contaminants or biohazards contained therein, all without requiring any physical contact with the contaminated cadaver.

Once all required or desired procedures have been concluded, for additional protection it is desirable to seal the ports 38, 40 and sleeves 42 to further reduce the risk of external contamination. As noted above, the means for accessing the interior of the envelope 20 are preferably sited along a side of the envelope 20 opposite the opening 22. Accordingly, when it is desired to seal the access means for accessing the interior of the envelope 20, personnel need only fold second adhesive flap 34 over to adhere to the envelope material, thereby covering and sealing the openings of sleeves 42 and infusion/extraction ports 38 and 40. In this manner, the safety margin for personnel handling the contaminated cadaver is further increased. The body bag 10 may then be lifted using handles 28, and transported for either preservation (freezing), destruction, or interment. For example, a significant period of time may elapse between the occurrence of a biological disaster and notification of family members for conclusive identification. Once the various identification procedures have been completed as described above, the cadaver may be cryopreserved for the necessary time period to allow notification of family members and positive identification of the body, prior to funerary procedures. If necessary, the body bag 10 may be placed in an interior of a conventional, opaque body bag (not shown) for a second level of protection during transport, and to prevent inadvertent viewing of the cadaver by family members, the press, and the like.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A body bag for isolating a cadaver, comprising:

a substantially planar, optically transparent envelope defining an interior for placement of the cadaver, said envelope having an opening extending substantially only along a length dimension thereof and adjacent on edge thereof; and a closure for impermeably sealing said opening;

an adhesive flap co-extending substantially the length of the opening and adapted for folding over and adhering to the envelope material whereby the opening is impermeably sealed.

2. The body bag of claim 1, wherein said envelope is dimensioned to allow placement in an interior of a conventional body bag.

3. The body bag of claim 1, wherein said closure comprises a rib and groove structure.

4. The body bag of claim 1, further including at least one access means formed through the envelope material for accessing the interior of said envelope, said access means being spaced along an opposite length dimension of the envelope from said opening.

5. The body bag of claim 4, further including a second adhesive flap integral to said envelope, said second adhesive flap adapted for folding over and adhering to the envelope material and co-extending along a sufficient length of said opposite length dimension to impermeably seal said access means when folded over.

6. The body bag of claim 4, wherein said access means is an injection port having a self-sealing septum.

7. The body bag of claim 4, wherein said access means is a unidirectional infusion port for infusing a substance into the interior of the envelope.

8. The body bag of claim 4, wherein said access means is a unidirectional extraction port for extracting a substance from the interior of the envelope.

9. The body bag of claim 1, wherein said access means is at least one sleeve extending from a surface of the envelope into the interior of the envelope and defining a glove, said sleeve further defining an opening formed through the envelope material.

10. The body bag of claim 1, further including at least one carrying handle.

11. The body bag of claim 1, further including at least one label for recording desired information on said envelope.

12. The body bag of claim 1, further including at least one ruled scale for measuring a length and/or width of an object placed in said envelope.

13. The body bag of claim 1, wherein said envelope includes unique identifier means for acquiring identification concerning a particular body bag at a distance.

14. The body bag of claim 13, wherein said unique identifier means is at least one scannable bar code for acquisition of identifying information regarding said cadaver from a distance.

15. A method for isolating a contaminated cadaver from contact with the environment, comprising the steps of:

placing said cadaver into an interior of a substantially planar, optically transparent envelope, said envelope having an opening extending substantially only along a length dimension and adjacent an edge of said envelope, a rib-and-groove closure for closing said opening, and a first adhesive flap integral to said envelope, said first adhesive flap co-extending substantially the length of the opening and adapted for folding over and adhering to the envelope material;

closing said rib and groove closure; and folding said first adhesive flap over to adhere to the envelope material, whereby the opening is impermeably sealed and the contents of the envelope are prevented from contact with an exterior of the envelope.

16. A body bag for holding and isolating a cadaver, comprising:

a substantially planar, optically transparent envelope defining an interior for placement of the cadaver, and having an opening extending substantially along a length dimension of said envelope;

a rib and groove closure for closing said opening;

a first adhesive flap integral to said envelope, said first adhesive flap co-extending substantially the length of the opening and adapted for folding over and adhering to the envelope material whereby the opening is impermeably sealed;

at least one access means formed through the envelope material for accessing the interior of said envelope, said access means being spaced along an opposite length dimension of the envelope from said opening and selected from the group consisting of an injection port having a self-sealing septum, a self-sealing unidirectional infusion port, a self-sealing unidirectional extraction port, and at least one sleeve extending from a surface of the envelope into the interior of the envelope and defining an opening formed through the envelope material and terminating in a glove, and any combination thereof;

a second adhesive flap integral to said envelope, said adhesive flap adapted for folding over and adhering to the envelope material and extending along a sufficient length of said opposite length dimension to impermeably seal said access means when folded over;

said envelope further including at least one scannable bar code on a surface thereof for acquisition of identifying information regarding said cadaver from a distance.

17. The body bag of claim 16, further including at least one carrying handle.

18. The body bag of claim 16, further including at least one label for recording desired information on said envelope.

19. The body bag of claim 16, further including at least one ruled scale for measuring a length and/or width of an object placed in said envelope.

* * * * *